United States Patent [19]

Franks

[11] Patent Number: 4,928,790

[45] Date of Patent: May 29, 1990

[54] RESTRAINING DEVICE

[75] Inventor: Jerry L. Franks, Hanahan, S.C.

[73] Assignee: South Carolina State Ports Authority, Charleston, S.C.

[21] Appl. No.: 380,515

[22] Filed: Jul. 17, 1989

[51] Int. Cl.[5] ..... A62B 35/00

[52] U.S. Cl. ..... 182/3; 248/228

[58] Field of Search ..... 182/3, 4; 248/228, 231.4, 248/231.6

[56] References Cited

U.S. PATENT DOCUMENTS

| | | | |
|---|---|---|---|
| 2,303,954 | 12/1942 | Roke | 182/3 |
| 3,137,487 | 6/1964 | Lesser | 182/3 |
| 3,217,833 | 11/1965 | Smith | 182/3 |
| 3,414,909 | 12/1968 | Provi | 248/228 |
| 4,052,028 | 10/1977 | Cordero | 182/3 |
| 4,567,961 | 2/1986 | Schoenfeld | 182/3 |
| 4,607,724 | 8/1986 | Hillberg | 182/3 |
| 4,630,708 | 12/1986 | Thompson | 182/12 |
| 4,633,974 | 1/1987 | Weiner | 182/12 |
| 4,699,245 | 10/1987 | Benedet | 182/3 |

*Primary Examiner*—Reinaldo P. Machado
*Attorney, Agent, or Firm*—B. Craig Killough

[57] ABSTRACT

A restraining device having an anchorage the length of which may by contacted so as to cause pads on the ends thereof to apply pressure to the sides of an elevated work surface to secure the anchorage, and further having a tether, one end of which is attached to the anchorage, and the opposite end of which is attached to a harness which is worn by a worker so as to keep the worker from falling from the elevated work surface.

9 Claims, 2 Drawing Sheets

RESTRAINING DEVICE

FIELD OF THE INVENTION

Background of the Invention

The present invention relates to a restraining device for preventing a worker from falling from an elevated work surface.

Preventing workers from falling from elevated heights is an important safety issue. Falls result in severe injury to workers, and result in lost time and expensive worker's compensation claims by the employee.

In particular, when shipping containers are received at a port it is necessary for a worker to release the containers from the hold-down means which attaches the container to the ships. These containers are stacked many units high, and the distance from the top of the upper most container to the deck of the ship or to the water may be great. The worker is placed at great risk of fall, which is aggravated by potential movement of the ship while the worker is walking about, due to wave conditions and the like.

It is inherently necessary for the container to be released from the ship by manual means. Accordingly, a worker must walk across the top of the stacked containers and release the containers from the hold-down means.

SUMMARY OF THE INVENTION

The present invention provides a device which will restrain the worker and prevent the worker falling off of a work surface. The device prevents the employee from leaving or falling off the work level or work position.

The present invention provides an anchoring device which may be clamped to a container. A restraint line is attached to the anchorage device at one end, and the opposite end of the restraint line is attached to a body harness worn by the worker. The anchorage device comprises a clamping means which will cause each end of the anchorage device to be pulled towards the center and to apply a clamping force to the container so as to secure the anchorage device to the container.

The present invention is contemplated for use with shipping containers, but could be used on any relatively flat surface having sides to which clamping force may be applied.

DETAILED DESCRIPTION OF THE DRAWINGS

DETAILED DESCRIPTION OF THE PREFERRED EMBODIMENT

Figure 1:
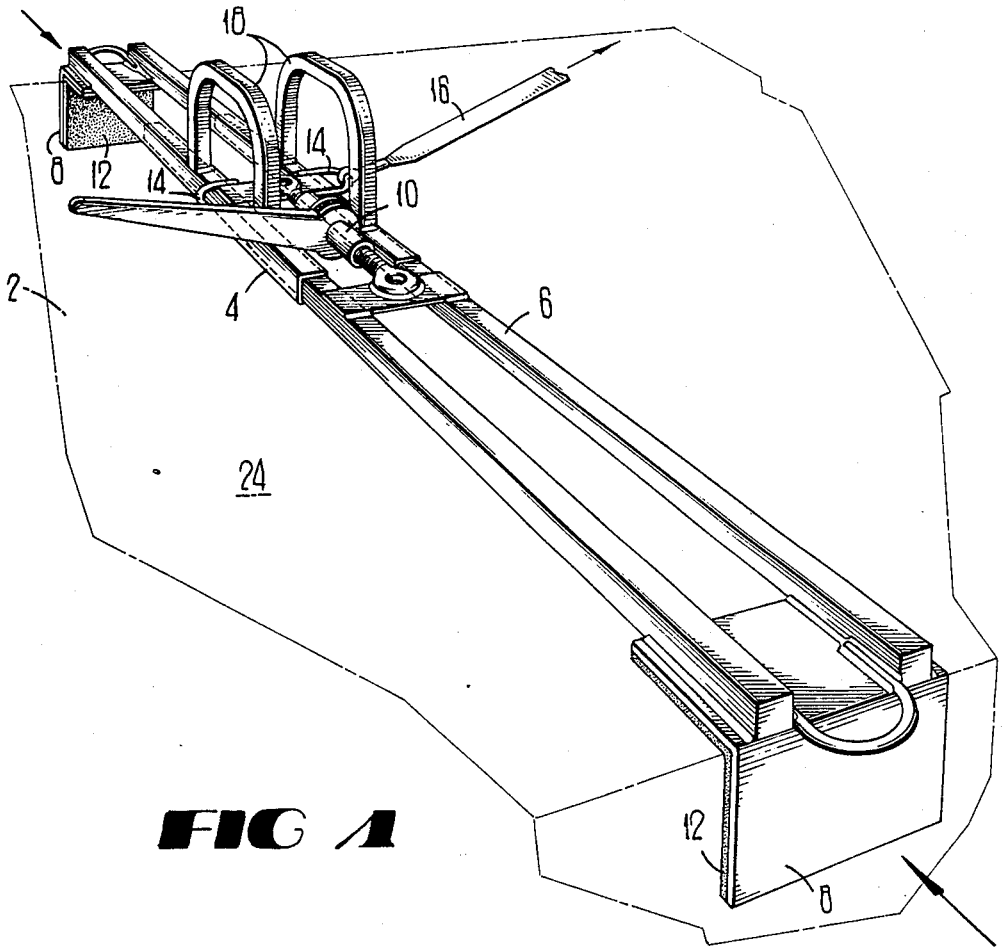
FIG. 1 shows a perspective view of the restraining device with the device clamped to the top of a container, with the container shown as a partial phantom.
Figure 2:
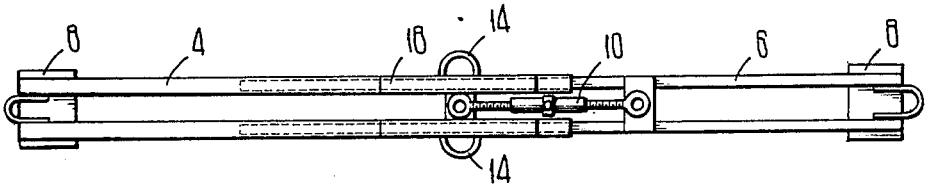
FIG. 2 is a top plan view of the restraining device.
Figure 3:
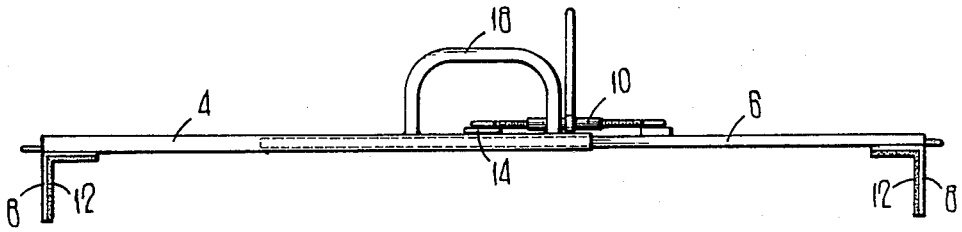
FIG. 3 is a side elevation of the restraining device.

Referring to the drawings, FIG. 1 shows the restraining device as it would typically be clamped to the work surface, such as a container 2. The anchorage comprises two slidable members 4, 6 which engage each other so as to provide for extension and contraction of the anchorage. At each end of the sliding members a clamping pad 8 is provided. Means for extending and contracting the slidable members 4,6 is provided at a point near where the sliding members 4,6 engage each other. The device may be affixed over a relatively flat work surface so that the clamping pads extend past each side thereof. A clamping actuator means 10 is then used to contract the sliding members 4,6 of the anchorage so that the clamping pads 8 apply clamping pressure and force to the side of the container or other work surface.

In the preferred embodiment, one sliding member 6 is inserted into the opposite sliding member 4 as shown in the drawing so as to allow the sliding members and the anchorage to be capable of expansion and contraction. One sliding member 6 engages the inside of a void in the end of the opposite sliding member 4 so as to travel therein, and so as to hold the sliding members together, while providing sufficient travel of the sliding members to provide adequate expansion and contraction.

A clamping pad 8 is affixed to the end of each sliding member. This clamping pad may be provided with a friction providing material 12 made of rubber or other resilient material, to improve the friction and clamping of the anchorage against the container or other work surface.

A clamping actuation means 10 is provided at the point where the sliding members engage each other. This clamping actuation means may be a rachet which pulls the clamping pads toward each other by pulling one of the sliding members into the opposite sliding member. Any known means which would cause the sliding members to contract in this fashion could be used, including motorized, hydraulic, or pneumatic means. It is only necessary that a means be provided for pulling the sliding members toward each other and be capable of providing sufficient force to securely hold the anchorage in place.

A loop 14 may be provided on the anchorage into which a restraint line 16 may be attached. The restraint line or tether may be nylon web straps, and should ideally have a breaking strength of not less than 10,000 pounds. A hook is provided on each end of the restraint line, with one hook being attached to the anchorage.

Figure 4:
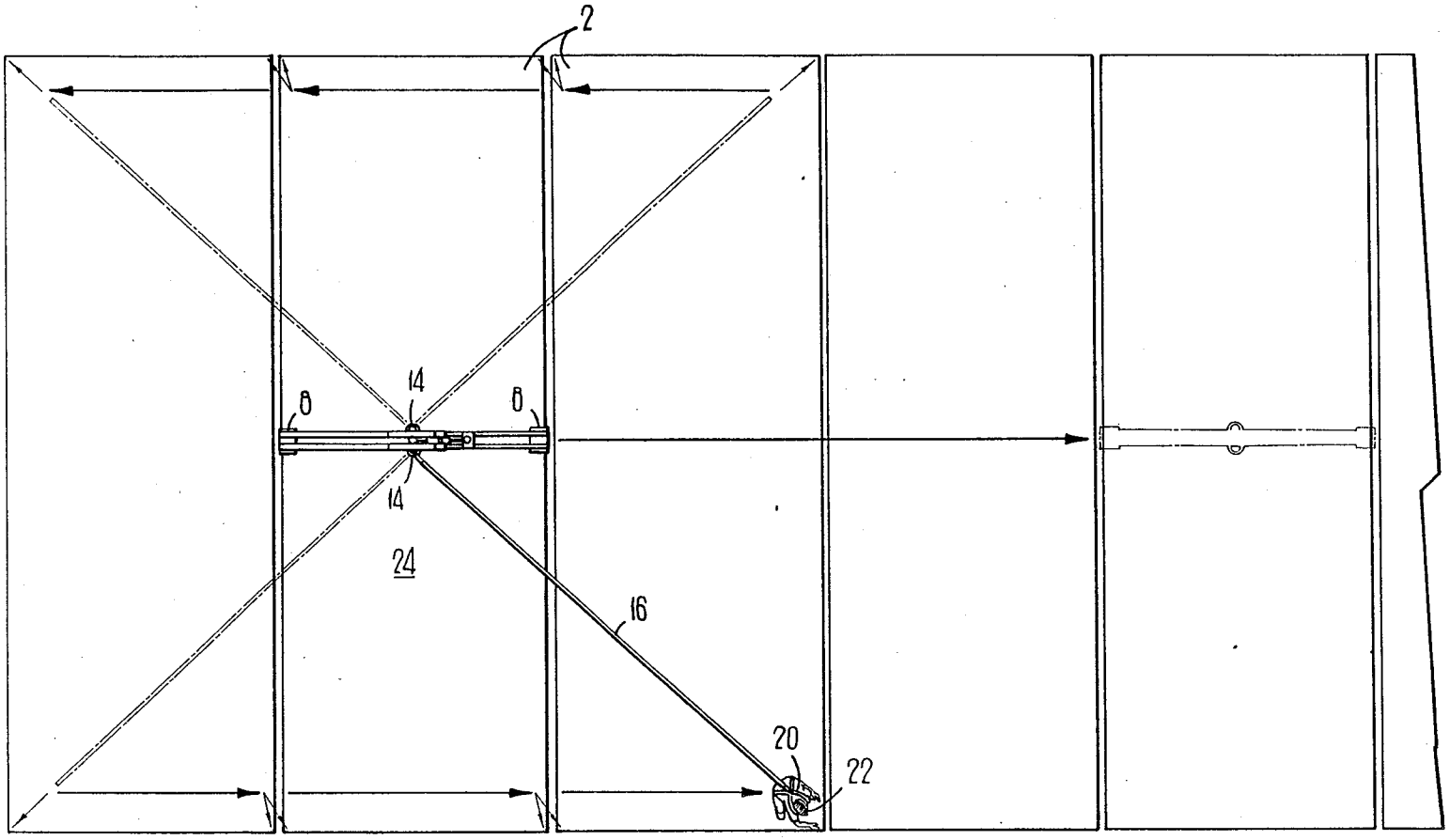
FIG. 4 is a plan view of the restraining device in use by a worker as he traverses an elevated work surface in the nature of shipping containers.

The opposite end of the restraint line 16 is attached to a body harness 20. The body harness may be any of the various types of body harnesses known in the art. The body harness should ideally attach to the tether line 16 in the back of the worker, and be of sufficient strength to hold the worker in case of a fall (FIG. 4). The length of the restraint line should be sufficient to allow adequate movement on the work surface, but be of a length which will prohibit or restrict the fall of the worker from the work surface.

The restraining device in general, and the anchorage in particular, are designed so that the device may be easily carried manually by the worker. Holds 18 may be provided to lift the device and manually transport it.

To use the device, the worker 22 will fit himself with the harness 20. He will then carry the tether line or restraint line detached from the body harness along with the anchorage to the work place. The worker will attach the anchorage to the work surface 24 in the desired position, based upon the location of the required work and the length of the restraint lines. The anchorage is placed so that the clamping pads extend over each edge of the work surface. A rachet means or other actuation means 10 is engaged so as to tighten the clamping pads against the sides of the work surface. The worker should then ensure that the anchorage is tightly clamped to the work surface.

The worker 22 may then attach the tether 16 to the anchorage, such as at loop 10, and to the body harness 16. He may then proceed with his job duties as required. The anchorage may be removed from the work surface by extending the sliding members by the rachet or other means. The worker may detach himself from the restraint line and from the anchorage and lift the anchorage away so as to move the anchorage to the next desired work position, as shown by the arrow in FIG. 4.

What is claimed is:

1. A restraining device comprising:

a. an anchorage whose length may be expanded and contracted, so as to cause each end of said anchorage to apply pressure to a work surface when the length of said anchorage is contracted, and to release said anchorage from said work surface when said length of said anchorage is expanded;

b. actuation means for contracting the length of said anchorage and expanding the length of said anchorage;

c. one or more restraining lines and means for removably attaching said restraining lines to said anchorage; and d. one or more safety harnesses worn by one or more workers to which an end of said restraining line opposite said anchorage is removably attached.

2. A restraining device, comprising:

a. an anchorage whose length may be expanded and contracted;

b. one or more clamping pads attached to each end of said anchorage;

c. actuation means for expanding and contracting the length of said anchorage so as to cause said clamping pads to apply clamping pressure to a work surface;

d. one or more restraining lines, and means for removably attaching said restraining lines to said anchorage; and e. one or more safety harnesses worn by one or more workers to which an end of each of said restraining lines, opposite said anchorage, is removably attached.

3. A restraining device as described in claim 2, wherein said actuation means for contracting said actuation anchorage is located at approximately a mid-point of said anchorage, and which pulls and pushes each end of said anchorage so as to cause said clamping pads to apply clamping pressure to said work surface.

4. A restraining device as described in claim 2, wherein said actuation means is a rachet.

5. A restraining device as described in claim 3, wherein said actuation means is a rachet.

6. A restraining device, comprising:

a. a first sliding member;

b. a second sliding member engaging said first sliding member in a slidable fashion so as to allow an overall length of said sliding members to be expanded and contracted;

c. one or more clamping pads attached to an end of each sliding member opposite the remaining sliding member;

d. actuation means for contracting said sliding members relative to each other so as to cause said clamping pads to apply clamping pressure to a work surface;

e. one or more restraining lines, and means for removably attaching said restraining lines to one or both of said sliding members; and f. one or more safety harnesses worn by one or more workers to which an end of each of said restraining lines opposite said sliding member is removably attached.

7. A restraining device as described in claim 6, wherein said actuation means for contracting said actuation anchorage is located at approximately a mid-point of said anchorage, and which pulls and pushes each end of said anchorage so as to cause said clamping pads to apply clamping pressure to said work surface.

8. A restraining device as described in claim 6, wherein said actuation means is a rachet.

9. A restraining device as described in claim 7, wherein said actuation means is a rachet.

* * * * *